US005768964A

United States Patent [19]

Meschi

[11] Patent Number: 5,768,964

[45] Date of Patent: Jun. 23, 1998

[54] METHOD AND DEVICE FOR SETTING UP A WEB OF PAPER HAVING LATERAL DRAGGING HOLES IN A PAPER PROCESSING AND/OR PRINTING APPARATUS

[75] Inventor: Luciano Meschi, Castiglioncello, Italy

[73] Assignee: Industria Grafica Meschi S.r.l., Livorno, Italy

[21] Appl. No.: 679,208

[22] Filed: Jul. 12, 1996

[30] Foreign Application Priority Data

Jul. 12, 1995 [IT] Italy ..... FI95A0163

[51] Int. Cl.[6] ..... B26F 1/02

[52] U.S. Cl. ..... 83/33; 83/371; 83/467.1

[58] Field of Search ..... 83/423, 371, 33, 83/369, 467.1, 686

[56] References Cited

U.S. PATENT DOCUMENTS 3,763,728 10/1973 Blackman ..... 83/371
3,854,359 12/1974 Tagami ..... 83/371
4,634,162 1/1987 Arnold ..... 83/33
4,768,410 9/1988 Wood ..... 83/371
5,036,739 8/1991 Clar ..... 83/423
5,470,300 11/1995 Terranova ..... 83/371

*Primary Examiner*—Kenneth E. Peterson
*Attorney, Agent, or Firm*—Browdy and Neimark

[57] ABSTRACT

A method and a device (10) for setting up a web (1) of paper having lateral dragging holes (2) in a paper processing and/or printing apparatus. The device (10) is capable of making a reference hole (3) at the midway line (4) between two successive lateral holes **(2*a*,2*b*). According to the method, when the web (1) is dragged by a paper dragger (7), reference hole (3) passes under a sensor (6) which signals the passage of it to a control unit. The control unit stores such passage and starts the linear measurement of the web from that moment, by an encoder. The control unit operates a perforating apparatus (8) which makes on the web transversal perforations (9) at the chosen distance for one another. Transversal perforations 9** are made coinciding with the midway line of two successive lateral dragging holes.

6 Claims, 2 Drawing Sheets

METHOD AND DEVICE FOR SETTING UP A WEB OF PAPER HAVING LATERAL DRAGGING HOLES IN A PAPER PROCESSING AND/OR PRINTING APPARATUS

DESCRIPTION

1. Field of the Invention

The present invention generally relates to the paper field and more precisely it relates to a method and a device for setting up a web of paper having lateral dragging holes in a paper processing and/or printing apparatus.

2. Description of the Prior Art

In paper processing and/or printing apparatus for continuous paper, webs are often used having lateral dragging holes which engage with paper-dragging rollers, or tractors, so that a precise control of the position of the paper throughout the apparatus is possible. In many cases, during the paper processing or printing, a transversal perforation is made dividing the paper in many consecutive sheets. In whichever moment, the paper may be torn along the perforations into single sheets or into packed groups of sheets.

Each transversal perforation preferably falls midway between two successive lateral dragging holes. Therefore, when introducing a new web of paper, which is unwound from a bobbin placed at the entry of the machine, a starting point must be fixed, from which all the automatic counting begins enabling the repetition of the transversal perforations on the entire following web through the apparatus. An example of a perforating apparatus capable of making transversal perforations however distanced from one another is described in EP 0646468, in the name of the same applicant.

The need of fixing a starting point is necessary in order to set up correctly a new web, also because the possible prints impressed on the paper must be centred in each sheet with reference to the transversal perforations which define two opposite borders.

The method which is at present more widely used to set a starting point for the paper consists in writing a mark onto the paper, such as a transversal dash at the midway between two successive lateral dragging holes. The position of this pen mark is then ready by an optical sensor when the web passes through the apparatus, the latter being so able to co-ordinate the moment in which the transversal perforation is made with the midway between two successive lateral dragging holes.

With the above described method, however, an initial loss of time is required and, besides, there is the possibility that the dash is marked not always in the same way and in the same position. The loss of time is due by the fact that, conveniently, the dash is marked on the paper at the half line of the first tractor of the apparatus. In fact, in this place the web is held by the teeth of the tractor which also provides a steady surface on which to mark the dash on the paper. This operation, however, entails the opening of the tractor at every initialisation, so that the mark can be impressed on the paper at the half line of the tractor itself. For the above reasons, it is clear that every time it is not easy to mark manually the paper at the exact midway between the holes and it is time consuming to pen the tractor.

SUMMARY OF THE INVENTION

It is the object of the present invention to provide a method and a device capable of simplifying and refining the operation described above, getting more homogeneous final products notwithstanding the change of the bobbins of paper at the entry, that is a web of paper having transversal perforations always at the midway between two successive lateral holes.

In accordance with this invention, a device is provided for setting up a web of paper having lateral dragging holes in a paper processing and/or printing apparatus. Each couple of successive dragging holes has a midway line orthogonal to said web and the device comprises

- a support integral to the apparatus and adjacent to the web,
- an opening made in the support in which the web can be introduced,
- centring means projecting from the support, the centring means being capable of being introduced into two successive dragging holes of the web, and
- piercing means mounted on the support and capable of making a reference hole in the paper at the midway line when it is centred on the centring means and is introduced into said opening.

According to preferred embodiments of the invention the piercing means comprises a piercing punch slideably mounted on the support, the punch moving in a plane orthogonal to the web and containing the midway line. In particular, the piercing punch comprises a stem having a piercing end and a holding end and the support has two coaxial supports with which said stem slidingly engages. Resilient means are further provided engaging with the stem and reversing the sliding of the stem in the direction from the piercing end to the holding end after the stem been pushed in the direction from said holding end to said piercing end to make the reference hole in the paper.

In addition, in accordance with this invention a method is provided for setting up a web of paper having lateral dragging holes in a paper processing and/or printing apparatus. Each couple of successive dragging holes has a midway line orthogonal to the web, and the apparatus has a control unit and sensing means of the passage of the paper communicating with the control unit. The method comprises the steps of:

- making a reference hole in the web at said midway line,
- sensing the passage of the paper dragged through the apparatus,
- communicating to the control unit the moment of the passage of the hole with respect to the sensing means, and
- starting the linear measurement of the web at the moment of said passage.

According to a preferred embodiment of the invention, the step of making a reference hole in the web on the midway line comprises a step of centring with respect to a piercing means the lateral dragging holes on whose midway line the reference hole is made.

BRIEF DESCRIPTION OF THE DRAWINGS

Further characteristics and advantages of the method and the device according to the present invention will be made clearer in the description which follows of one of its possible embodiments, given as an example, but not limitative, with reference to the above-mentioned drawings, in which.

DESCRIPTION OF THE PREFERRED EMBODIMENT

Figures 1, 1A:
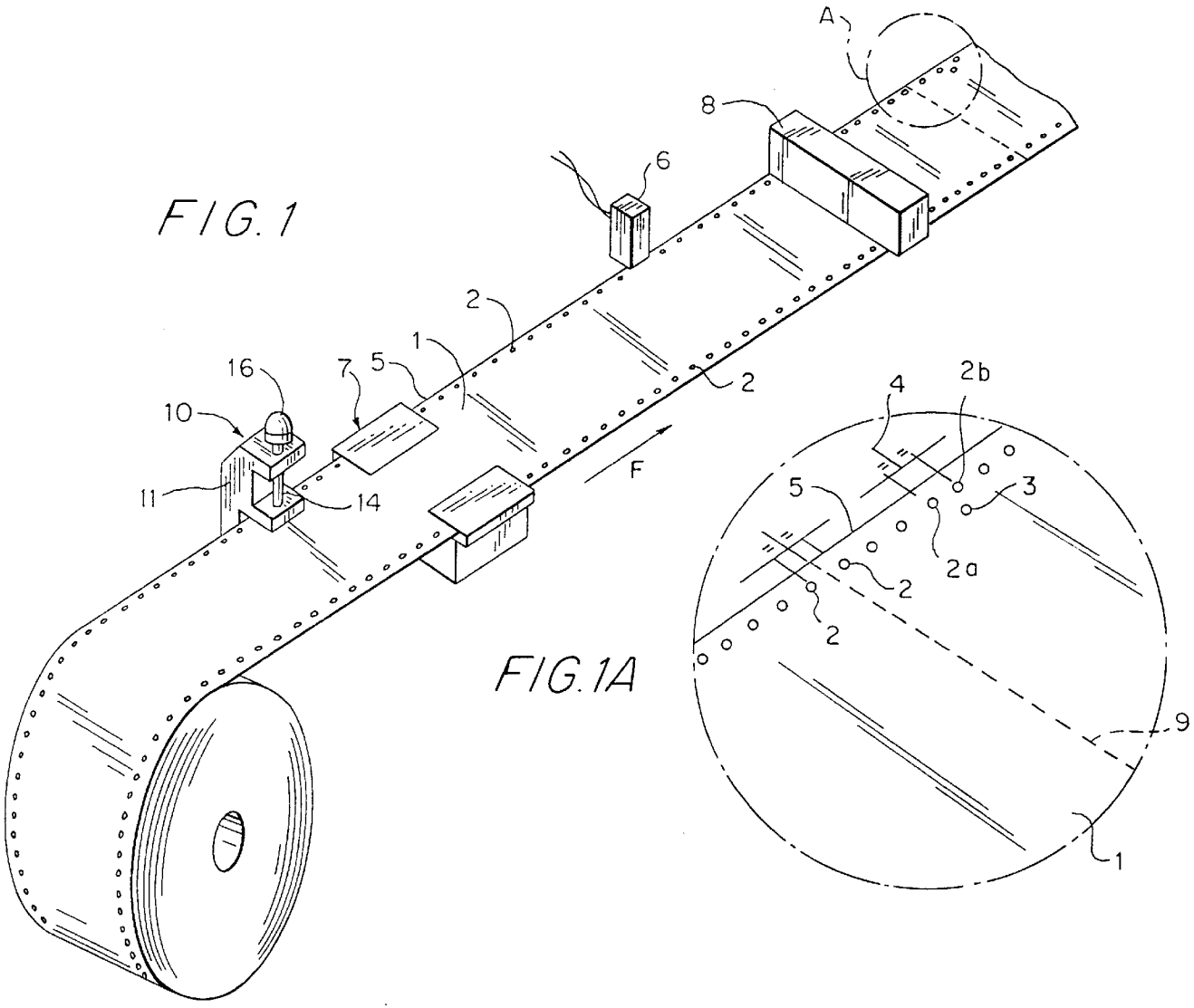
FIG. 1 shows a diagrammatic view the sequence of steps for setting up a new web of paper following the method according to the invention.

With reference to FIG. 1, in order to initialise or set up a new web of paper 1, having lateral dragging holes 2, it is sufficient to make a reference hole 3 (more clearly shown in the enlarged particular) at the midway line 4 between two successive lateral holes 2*a* and 2*b*. Reference hole 3 is preferably out of alignment with respect to dragging holes 2, and, in particular, it is more distant from the border 5 of the web 1 than they are.

When web 1 is dragged by a paper dragging means 7 in the direction indicated by arrow F, reference hole 3 passes under a sensor 6 which signals the passage of it to a control unit. The control unit stores such passage and starts the linear measurement of the web from that moment, by means of encoder means. In particular, the control unit operates a perforating apparatus 8 which makes on the web transversal perforations 9 at the chosen distance from one another. Transversal perforations 9 are made coinciding with the midway line of two successive lateral dragging holes. The control unit and the encoder means are not described in detail since they are common in such type of apparatus and therefore can be easily implemented by a person skilled in the art.

Figure 2:
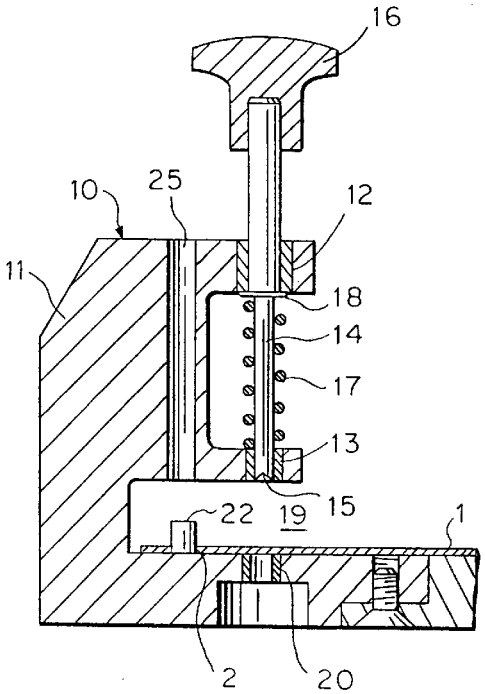
FIG. 2 shows an elevational lateral cross-sectional view of a device according to the invention for setting up a new web of paper.
Figure 3:
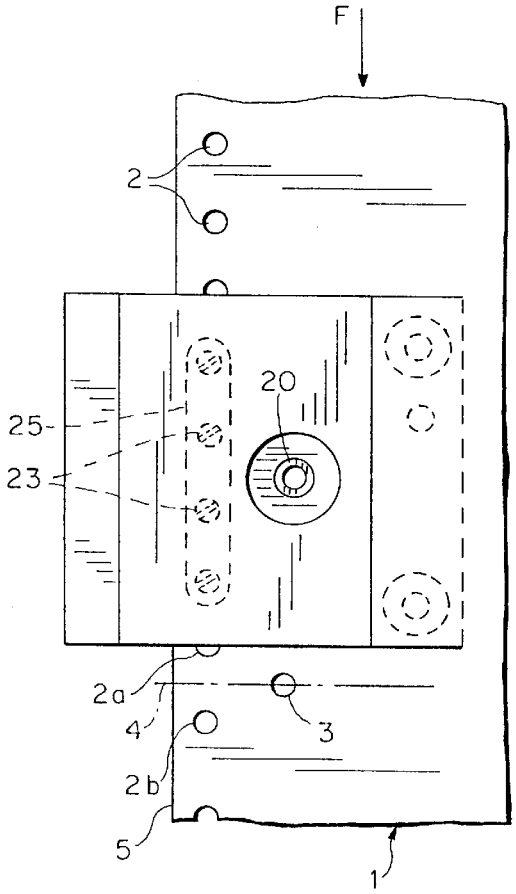
FIG. 3 shows a plan view from the bottom of the device shown in FIG. 2.
Figure 4:
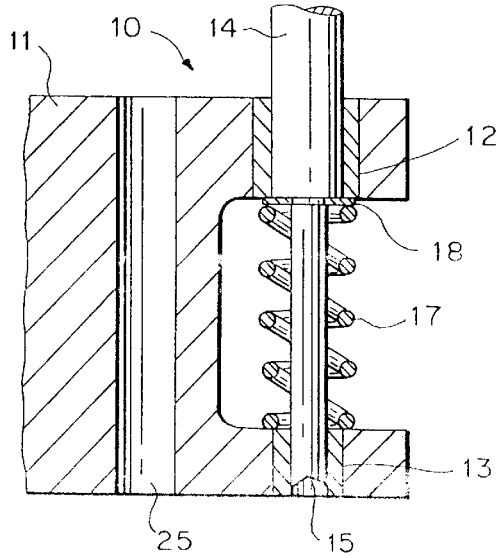
FIG. 4 shows a detailed elevational cross-sectional view of the device shown in FIG. 2.

In order to assure that the reference hole 3 is made in the paper at the exact correspondence with midway line 4 between two successive lateral holes 2*a* and 2*b*, a device 10 according to the invention is provided, shown in detail in FIGS. 2, 3 and 4. Device 10 comprises a support 11 having two coaxial guides 12 and 13 with a stem 14 slidingly engages. At one end stem 14 has a piercing punch 15, and at the other end a knob 16. Between supports 12 and 13 a spring 17 is provided engaging against a shoulder 18.

Support 11 also comprises an opening 19 in which web 1 can be introduced. Coaxially to guides 12 and 13, beyond opening 19, a bush 20 is provided in which piercing punch 15 engages, after having made hole 3, when knob 16 is pushed downwards. Centring pins 22 protruding into opening 19 are fixed to support 11 by means of screws 23. Pins 22 are capable of being introduced into two successive dragging holes 2 of said web, and in particular into holes 2*a* and 2*b*, so that punch 15 exactly pierces web 1 making reference hole 3 centred on midway line 4. The introduction of web 1 onto pins 22 is made easier by the presence of a window 25 in support 11, allowing a user to see from the above pins 22 while engaging with holes 2.

The user, therefore, betfore arranging the web on the apparatus by putting it onto the paper dragging rollers 7, introduces the border 5 of the web 1 into opening 19, engaging pins 22 into holes 2*a* and 2*b*, that are two whichever successive lateral dragging holes of the web. Then pushes downwards stem 14 by means of knob 16, so that punch 15 pierces the web and makes hole 3. This step, in its whole, is very quick and easy, and does not require particular attention, assuring, at the same time, high precision in the position of hole 3.

Then, the user puts the web on the dragging device 7 and starts the dragging. When hole 3 passes under sensor 6, the linear measurement of web 1 is started, in other words it is set to zero, this zero corresponding to a point which is surely at the midway between two successive lateral dragging holes, thus reaching the object of the invention. In this way, all the transversal perforations made on the web will be made at the midway between two lateral dragging holes.

The foregoing description of a specific embodiment will so fully reveal the invention according to the conceptual point of view, so that others, by applying current knowledge, will be able to modify and/or adapt for various applications such an embodiment without further research and without departing from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

I claim:

1. A method for setting up a web of paper for further processing, comprising the steps of;

providing a web of paper having a pair of lateral edges and a row of lateral dragging holes aligned along at least one of said lateral edges, each couple of successive dragging holes being bisected by a midway line orthogonal to said lateral edges of said web, providing an apparatus having a hole making means, a control unit and a hole sensing means, using the hole making means to make a reference hole in said web on a midway line, conveying said web thru said apparatus, sensing said reference hole with said sensor, said sensor sending a communication to said control means the moment the sensor senses said reference hole, starting the linear measurement of said web upon receipt of said communication by said control means such that an exact position of the midway lines will be known for further processing.

2. Method according to claim 1, wherein said hole making means comprises a piercing means capable of making said hole on said web and said step of making a reference hole in said web on said midway line comprises a step of centring with respect to said piercing means the lateral dragging holes on whose midway line said reference hole is made.

3. A method according to claim 1 wherein said hole making means further includes:

a support integral to said apparatus and adjacent to said web;

an opening made in said support into which said web is introduced;

centering means projecting from said support, said centering means being introduced into two successive dragging holes of said web; and piercing means mounted on said support making a reference hole in said paper at said reference line when it is centered on said centering means and is introduced into said opening.

4. A method according to claim 3, wherein said piercing means comprises a piercing punch slidably mounted on said support, said punch sliding in a plane orthogonal to said web and containing said midway line.

5. A method according to claim 4, wherein said piercing punch comprises a stem having a piercing end and a holding end, said support having two coaxial guides with which said stem slidingly engages.

6. A method according to claim 4, wherein resilient means are provided engaging with said stem and reversing the sliding of said stem in the direction from said piercing end to said holding end after it has been pushed in the direction from said holding end to said piercing end to make said reference hole in said paper.

* * * * *